US007829253B2

(12) United States Patent
Sweeney et al.

(10) Patent No.: US 7,829,253 B2
(45) Date of Patent: Nov. 9, 2010

(54) TONER COMPOSITION

(75) Inventors: Maura Sweeney, Irondequoit, NY (US); Grazyna Kmiecik-Lawrynowicz, Fairport, NY (US); Robert D. Bayley, Fairport, NY (US); Kristen Leskow, Endwell, NY (US)

(73) Assignee: Xerox Corporation, Stamford, CT (US)

( * ) Notice: Subject to any disclaimer, the term of this patent is extended or adjusted under 35 U.S.C. 154(b) by 1309 days.

(21) Appl. No.: 11/351,439

(22) Filed: Feb. 10, 2006

(65) Prior Publication Data

US 2007/0190441 A1 Aug. 16, 2007

(51) Int. Cl.
*G03G 9/087* (2006.01)

(52) U.S. Cl. ..... 430/108.4; 430/109.3

(58) Field of Classification Search ..... 430/108.4, 430/109.3

See application file for complete search history.

(56) References Cited

U.S. PATENT DOCUMENTS 5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
6,106,988 A 8/2000 Furukawa et al.
6,656,653 B2 * 12/2003 Mitsuhashi et al. .... 430/108.23

OTHER PUBLICATIONS

Whelan, T., ed., Polymer Technology Dictionary, Chapman & Hall, London (1994), p. 256.*
Grant, R., et al., ed., Grant & Hackh's Chemical Dictionary, Fifth Edition, McGraw-Hill Book Company, NY (1987), pp. 405 and 553.*
Diamond, A.S.,et al., Handbook of Imaging Materials, Second Edition, Marcel Dekker, Inc., NY (2002), pp. 146-148.*

* cited by examiner

*Primary Examiner*—Janis L Dote
(74) *Attorney, Agent, or Firm*—Carter, DeLuca, Farrell & Schmidt, LLP

(57) ABSTRACT

Toner compositions having high molecular weight and improved melt flow are provided.

8 Claims, 1 Drawing Sheet

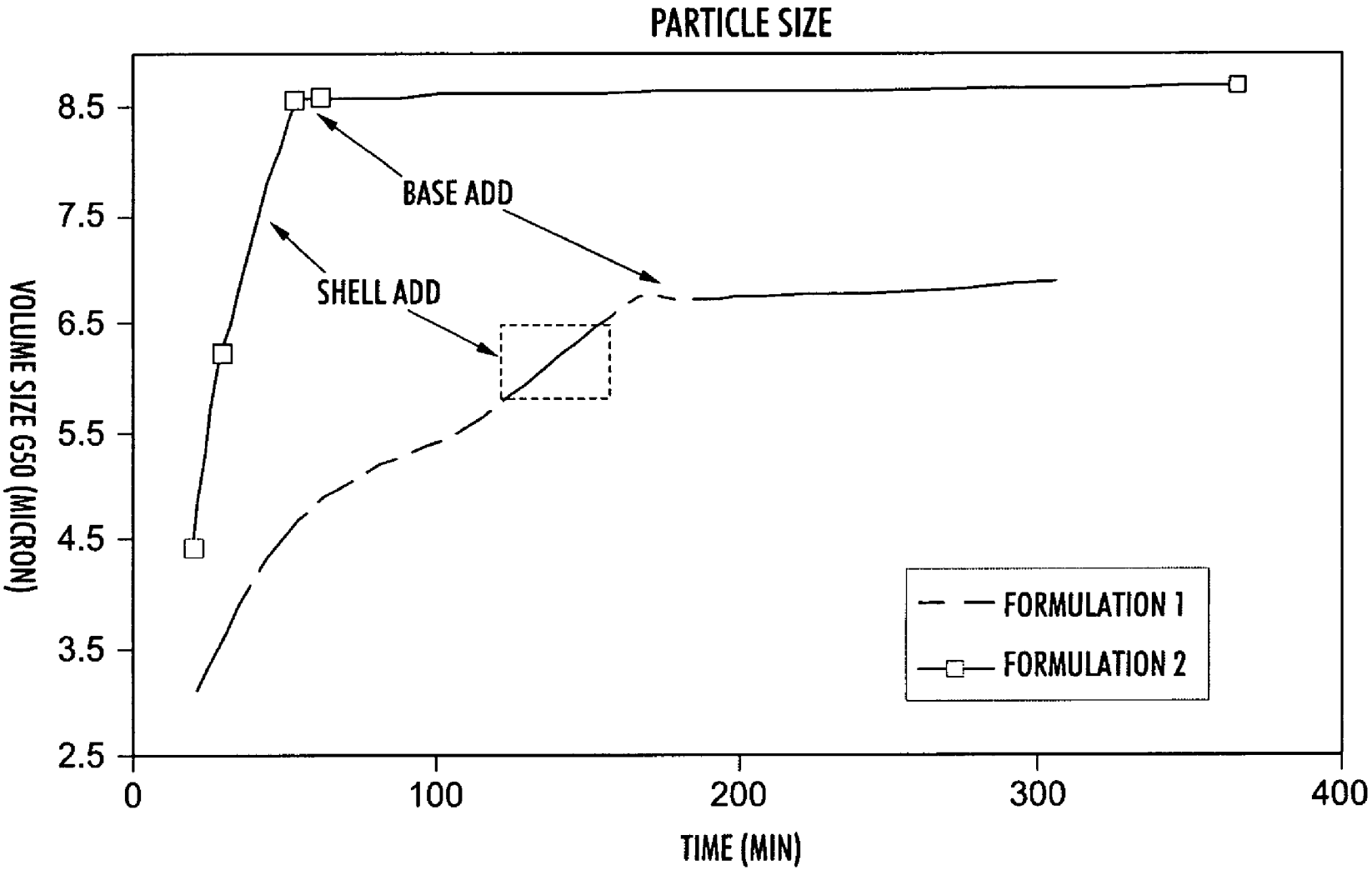
PARTICLE SIZE
BASE ADD
SHELL ADD
FORMULATION 1
FORMULATION 2
VOLUME SIZE G50 (MICRON)
8.5
7.5
6.5
5.5
4.5
3.5
2.5
0
100
200
300
400
TIME (MIN)

TONER COMPOSITION

BACKGROUND

The present disclosure relates generally to toners and toner processes, and more specifically, to toner compositions with improved melt flow.

In electrophotography, an image is produced by forming an electrostatic latent image on a surface of a photoreceptor having a drum or belt shape, or the like, developing the electrostatic latent image with a toner so as to obtain a toner image, electrostatically transferring the toner image onto a recording media such as paper directly or via an intermediate transfer member, and fusing the toner onto a surface of the recording paper by heating, or the like.

A number of aspects of the overall print quality are affected by the rheology, or viscoelasticity, of the toners used to develop the print. The aspects of the overall print quality affected include overall gloss level of the image, the differential gloss of the image, the fix level of the image (for example as measured by either crease or rub testing), color-to-color fix level differences, and image quality defects associated with offset of the image, either to the fusing roll during the fusing process (hot offset) or to other surfaces after the print has exited the machine (vinyl or document offset). In addition, toner rheology also affects toner fuser roll life, for example, the rate at which toner builds up on the toner fuser roll of an image forming device using the toner to develop images.

Toner may be made by an emulsion aggregation process. Methods of preparing an emulsion aggregation (EA) type toner are known and toners may be formed by aggregating a colorant with a latex polymer formed by batch or semi-continuous emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.5 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

In view of the recent demand for high image quality, toner with improved fusing, for example improved melt is desired. Melt flow index is an accurate reflection of the rheology, or viscoelasticity, of the toners used to develop a print. Hence, an improved melt flow index of a toner is an indication of an improved print quality.

In the developing and transferring properties of a toner, the molecular weight of the toner exhibits large influence on performance, reliability, and melt flow. Toners made by the above methods may have a molecular weight below about 50 kpse. Toners with a molecular weight below 50 kpse may be used in single component development systems. The low molecular weight toners flow well through these development systems. Unfortunately, these low molecular weight toners tend to lose their charge and form in the toner housing such that they consequentially break or are easily crushed. Hence, these low molecular weight toners are not as robust as higher molecular weight toners. In contrast, higher molecular weight toners typically do not flow well resulting in poor image quality.

Hence, it would be advantageous to provide a toner composition with high molecular weight latex that has an improved melt flow index.

SUMMARY

The present disclosure provides a toner composition that includes a latex having a molecular weight of from about 70 kpse to about 250 kpse and a wax having a melting point of from about 75° C. to about 85° C.

Further provided is a process of making toner which includes contacting a latex having a molecular weight of from about 70 kpse to about 250 kpse, an aqueous colorant dispersion, and a wax dispersion having a melting point of from about 75° C. to about 85° C.; mixing the above blend with a coagulant; heating the mixture to form an aggregated suspension; adding a base to increase the pH to a value of from about 4 to about 7; heating the aggregated suspension to coalesce the aggregated suspension to form toner; recovering said toner.

In embodiments, the present disclosure provides a xerographic system. The xerographic system includes a charging component, an imaging component, a development component, a transfer component and a fixing component, wherein the development component comprises a toner composition having a latex with a molecular weight of from about 70 kpse to about 250 kpse and a wax with a melting point of from about 75° C. to about 85° C.

The present disclosure also provides a xerographic process. The xerographic process includes depositing a toner composition on a latent electrostatic image, the toner composition having a latex with a molecular weight of from about 70 kpse to about 250 kpse and a wax with a melting point of from about 75° C. to about 85° C.; transferring the image to a support surface; and affixing the image to the support surface.

BRIEF DESCRIPTION OF THE DRAWINGS

Various embodiments of the present disclosure will be described herein below with reference to the FIGURES wherein:

The FIGURE is a graphical correlation showing the particle size of a control toner and a high molecular weight toner made with a montan wax octadecyl alcohol monoester.

DETAILED DESCRIPTION

In accordance with the present disclosure, toner compositions are provided which include a latex having a high molecular weight and a low melt wax.

The toner compositions generated in embodiments of the present disclosure include, for example, a latex having an average molecular weight (Mw) of from about 70 kpse to about 250 kpse, and in embodiments of from about 75 kpse to about 150 kpse. In embodiments, the latex may have a glass transition temperature of from about 54° C. to about 65° C., and in embodiments, of from about 55° C. to about 61° C. The toner compositions further include a wax with a melting point of from about 75° C. to about 85° C., and in embodiments of from about 75° C. to about 81° C.

Toners produced with the latex and wax of the present disclosure have a melt flow index (MFI) of from about 5 gm/10 min to about 40 gm/10 min, and in embodiments, of from about 10 gm/10 min to about 30 gm/10 min. MFI as used herein includes, in embodiments, for example, the weight of a toner (in grams) which passes through an orifice of length L and diameter D in a 10 minute period with a specified applied load. In accordance with the present disclosure, the conditions for determining the MFI of a toner may be a temperature of about 130° C. and an applied load of about 16.6 kilograms. An MFI unit of 1 thus indicates that only 1 gram of the toner passed through the orifice under the specified conditions in 10 minutes time. "MFI units" as used herein thus refers to units of grams per 10 minutes.

In embodiments, the toners may be an emulsion aggregation type toner prepared by the aggregation and fusion of latex resin particles and waxes with a colorant, and optionally one or more additives such as surfactants, coagulants, surface additives, and mixtures thereof. In embodiments, one or more may be from about one to about twenty, and in embodiments from about three to about ten.

As described earlier, a suitable latex may have an average molecular weight (Mw) of from about 70 kpse to about 250 kpse, and in embodiments of from about 75 kpse to about 150 kpse. In embodiments, the latex may have a glass transition temperature of from about 54° C. and about 65° C., and in embodiments, of from about 55° C. to 61° C. In embodiments, the latex which may be utilized includes, for example, submicron non-crosslinked resin particles having a size of, for example, from about 50 to about 500 nanometers, in embodiments from about 100 to about 400 nanometers in volume average diameter as determined, for example, by a Brookhaven nanosize particle analyzer. The non-crosslinked resin may be present in the toner composition in an amount from about 75 weight percent to about 98 weight percent, and in embodiments from about 80 weight percent to about 95 weight percent of the toner or the solids of the toner. The expression solids can refer, in embodiments, for example to the latex, colorant, wax, and any other optional additives of the toner composition.

In embodiments of the present disclosure, the non-crosslinked resin in the latex may be derived from the emulsion polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA) and the like.

In embodiments, the non-crosslinked resin of the latex may include at least one polymer. In embodiments, at least one may be from about one to about twenty and, in embodiments, from about three to about ten. Exemplary polymers includes styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof. In embodiments, the polymer is poly(styrene/butyl acrylate/beta carboxylethyl acrylate). The polymer may be block, random, or alternating copolymers.

In embodiments, the latex may be prepared by a batch or a semicontinuous polymerization resulting in submicron non-crosslinked resin particles suspended in an aqueous phase containing a surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments a suitable anionic surfactant includes NEOGEN RK available from Daiichi Kogyo Seiyaku Co. Ltd., or TAYCA POWER BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL™ and ALKAQUAT™ available from Alkaril Chemical Company, SANISOL™ (benzalkonium chloride), available from Kao Chemicals, and the like. In embodiments a suitable cationic surfactant includes SANISOL B-50™ available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. In embodiments a suitable nonionic surfactant is ANTAROX 897 available from Rhone-Poulenc Inc., which is primarily an alkyl phenol ethoxylate.

In embodiments, the non-crosslinked resin may be prepared with initiators, such as water soluble initiators and organic soluble initiators. Exemplary water soluble initiators include ammonium and potassium persulfates which can be added in suitable amounts, such as from about 0.1 to about 8 weight percent, and in embodiments of from about 0.2 to about 5 weight percent of the monomer. Examples of organic soluble initiators include Vazo peroxides, such as VAZO 64™, 2-methyl 2-2'-azobis propanenitrile, VAZO 88™, and 2-2'-azobis isobutyramide dehydrate and mixtures thereof. Initiators can be added in suitable amounts, such as from about 0.1 to about 8 weight percent, and in embodiments of from about 0.2 to about 5 weight percent of the monomers.

Known chain transfer agents can also be utilized to control the molecular weight properties of the resin if prepared by emulsion polymerization. Examples of chain transfer agents include dodecane thiol, dodecylmercaptan, octane thiol, carbon tetrabromide, carbon tetrachloride and the like in various suitable amounts, such as from about 0.1 to about 20 percent, and in embodiments of from about 0.2 to about 10 percent by weight of the monomer.

Other processes for obtaining resin particles include those produced by a polymer microsuspension process as disclosed in U.S. Pat. No. 3,674,736, the disclosure of which is hereby incorporated by reference in its entirety, a polymer solution microsuspension process as disclosed in U.S. Pat. No. 5,290,654, the disclosure of which is hereby incorporated by reference in its entirety, and mechanical grinding processes, or other known processes.

In embodiments, a gel latex may be added to the non-crosslinked latex resin suspended in the surfactant. A gel latex may refer, in embodiments, for example to a crosslinked resin or polymer, or mixtures thereof, or a non-crosslinked resin with crosslinking. In embodiments of the present disclosure, the gel latex may be a mixture of a crosslinked resin and a non-crosslinked resin.

The gel latex may include, for example, submicron crosslinked resin particles having a size of, for example, from about 10 to about 200 nanometers, and in embodiments from about 20 to 100 nanometers in volume average diameter. The gel latex may be suspended in an aqueous phase of water containing a surfactant, wherein the surfactant is selected in an amount from about 0.5 to about 5 percent by weight of the solids, and in embodiments from about 0.7 to about 2 percent by weight of the solids.

The crosslinked resin may be a crosslinked polymer such as crosslinked styrene acrylates, styrene butadienes, and/or styrene methacrylates. In particular, exemplary crosslinked resins are crosslinked poly(styrene-alkyl acrylate), poly(styrene-butadiene), poly(styrene-isoprene), poly(styrene-alkyl methacrylate), poly(styrene-alkyl acrylate-acrylic acid), poly (styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly (alkyl acrylate-acrylonitrile-acrylic acid), and mixtures thereof.

A crosslinker, such as divinyl benzene or other divinyl aromatic or divinyl acrylate or methacrylate monomers may be used in the crosslinked resin. The crosslinker may be present in an amount of from about 0.01 percent by weight to about 25 percent by weight, and in embodiments of from about 0.5 to about 15 percent by weight of the crosslinked resin.

The crosslinked resin particles may be present in an amount of from about 0.1 to about 50 percent by weight, and in embodiments of from about 1 to about 20 percent by weight of the toner.

The latex and gel latex may be added to a colorant dispersion. The colorant dispersion may include, for example, submicron colorant particles having a size of, for example, from about 50 to about 500 nanometers, and in embodiments of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and from about 1 to about 25 percent by weight, in embodiments from about 4 to about 15 percent by weight of the colorant.

Colorants include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33,2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

As stated earlier, the toner compositions of the present disclosure further include a wax with a melting point of from about 75° C. to about 85° C., and in embodiments of from about 75° C. to about 81° C. The wax enables toner cohesion and prevents the formation of the toner aggregates. In embodiments, the wax is in a dispersion. Wax dispersions suitable for use in toners of the present disclosure include, for example, submicron wax particles having a size of from about 50 to about 500 nanometers, in embodiments of from about 100 to about 400 nanometers in volume average diameter. The wax particles may be suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure may include any suitable wax such as a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and mixtures thereof. In embodiments, the wax is a Montan wax octadecyl alcohol monoester.

Examples of polypropylene and polyethylene waxes include those commercially available from Allied Chemical and Baker Petrolite, wax emulsions available from Michelman Inc. and the Daniels Products Company, EPOLENE™ N-15 commercially available from Eastman Chemical Products, Inc., VISCOL™ 550-P, a low weight average molecular weight polypropylene available from Sanyo Kasel K.K., and similar materials. In embodiments, commercially available polyethylene waxes possess a molecular weight (Mw) of from about 1,000 to about 1,500, and in embodiments of from about 1,250 to about 1,400, while the commercially available polypropylene waxes have a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL™ 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, and in embodiments from about 2 to about 20 percent by weight of the toner.

The resultant blend of latex dispersion, gel latex dispersion, colorant dispersion, and wax dispersion may be stirred and heated to a temperature of from about 45° C. to about 65° C., in embodiments of from about 48° C. to about 63° C., resulting in toner aggregates of from about 4 microns to about 8 microns in volume average diameter, and in embodiments of from about 5 microns to about 7 microns in volume average diameter.

In embodiments, a coagulant may be added during or prior to aggregating the latex, the aqueous colorant dispersion, the wax dispersion and the gel latex. The coagulant may be added over a period of time from about 1 to about 5 minutes, in embodiments from about 1.25 to about 3 minutes.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 0.3 percent by weight of the toner, and in embodiments from about 0.05 to about 0.2 percent by weight of the toner.

Optionally a second latex can be added to the aggregated particles. The second latex may include, for example, submicron non-crosslinked resin particles. The second latex may be added in an amount of from about 10 to about 40 percent by weight of the initial latex, and in embodiments in an amount of from about 15 to about 30 percent by weight of the initial latex, to form a shell or coating on the toner aggregates wherein the thickness of the shell is from about 200 to about 800 nanometers, and in embodiments from about 250 to about 750 nanometers.

In embodiments of the present disclosure, the latex and the second latex may be the same non-crosslinked resin.

In embodiments, the latex and the second latex may be different non-crosslinked resins.

Once the desired final size of the particles is achieved with a volume average diameter of from about 4 microns to about 9 microns, and in embodiments of from about 5.6 microns to about 8 microns, the pH of the mixture may be adjusted with a base to a value of from about 4 to about 7, and in embodiments from about 6 to about 6.8. Any suitable base may be used such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, in embodiments from about 10 to about 20 percent by weight of the mixture.

The mixture is subsequently coalesced. Coalescing may include stirring and heating at a temperature of from about 90° C. to about 99° C., for a period of from about 0.5 to about 6 hours, and in embodiments from about 2 to about 5 hours. Coalescing may be accelerated by additional stirring.

The pH of the mixture is then lowered to from about 3.5 to about 6 and, in embodiments, to from about 3.7 to about 5.5 with, for example, an acid to coalesce the toner aggregates. Suitable acids include, for example, nitric acid, sulfuric acid, hydrochloric acid, citric acid and/or acetic acid. The amount of acid added may be from about 4 to about 30 percent by weight of the mixture, and in embodiments from about 5 to about 15 percent by weight of the mixture.

The mixture is cooled, washed and dried. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

The washing may be carried out at a pH of from about 7 to about 12, and in embodiments at a pH of from about 9 to about 11. The washing may be at a temperature of from about 45° C. to about 70° C., and in embodiments from about 50° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying is typically carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The toner may also include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by a magnetic brush development process as disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

Latex Synthesis

As disclosed above, latex particles may be prepared by a semi-continuous or batch emulsion polymerization process. In this example, a batch process was used to make the emulsion. Latex 1 was prepared as follows: To a 2-gallon reactor equipped with a stainless-steel stirrer, condenser, nitrogen inlet, thermometer, $I^2R$ thermocouple adapter, and internal cooling coil the following material was added. About 2902 g deionized water and about 41 g sodium dodecyl diphenyloxide disulfonate were charged and brought to an internal temperature of about 75° C. This was allowed to stir at about 150 rpm for a minimum of about 30 minutes under nitrogen flow to displace the oxygen. A mixture of about 1581 g styrene, about 58.05 g Beta CEA, about 6.77 g dodecaneciol diacrylate (A-DOD), about 5.416 g dodecanethiol and 354.11 g butyl acrylate was made. The mixture was dispersed under high sheer conditions in a separate mixing vessel to form a homogenous emulsion.

The reactor was then charged with about 29.83 g of the aforementioned emulsion as a seed monomer. The seed monomer was allowed to stir for about 10 minutes to disperse the monomer in the water phase with the surfactant. To initiate polymerization, a mixture of about 29.02 g ammonium persulfate (APS) dissolved in about 143.45 mL deionized water was added to the reactor. Once initiation took place, which was evident by a white cloudy appearance, the remaining homogenized monomer from the mixing vessel was fed in at a controlled rate to grow the particles to their desired size of from about 190 nm to about 260 nm. After monomer addition was complete, the polymerization was allowed to continue for about 2 hours at about 75° C. to complete conversion of monomer to polymer.

The resulting latex, Latex 1 (styrene/butylacrylate resin) had a Mw/Tg (72.8 kpse and 55.4° C. Tg as determined by GPC and DSC) that contributed to toner robustness and toughness. The latex had a reduced level of dodecanethiol (DDT) to other EA toners that not only increased the molecular weight but also decreased the odor of the latex that can be incorporated into the toner particles.

Toner Synthesis:

The E/A toner formulations were made using the styrene/butylacrylate resin in Example 1. The following components were first homogenized then mixed: the high Mw resin (Latex 1), pigment, polyethylene wax control or low melt LICOWAX® (Montan wax octadecyl alcohol monoester), polyaluminum chloride (or other coagulating agent) at about 60° C. The mixture was grown to the desired size of about 5.6 μm. The outer shell was then added until the appropriate particle size was reached of from about 7 μm to about 8 μm, and then growth was halted with the addition of a base such as sodium hydroxide and adjusted to pH of about 4.5. The particles were then coalesced at an elevated temperature of about 98° C. until a spherical shape was achieved (measured using the Malvern Sysmex FPIA e3000). Particles were then wet sieved, washed by filtration then freeze-dried. The actual labscale formulations are found in Tables 1 and 2.

TABLE 1

| Formulation 1 High Mw Latex 1 with Polyethylene Wax (control) | Grams |
|---|---|
| Deionized water | 774.48 |
| Pigment PB 15:3 Lot#W92914 | 69.42 |
| Core Latex 1, 72.8 Mw, 55.4 Tg | 357.93 |
| P725 Wax 30% solids | 76.88 |
| PAC Lot #4020914030 | 4.50 |
| 0.2 M $HNO_3$ | 40.50 |
| Shell Latex 1 | 177.22 |

TABLE 2

| Formulation 2 High Mw Latex 1 with Novel LICOWAX ® | Grams |
|---|---|
| Deionized water | 620.73 |
| Pigment PB 15:3 Lot#W92914 | 69.42 |
| Core Latex 1, 72.8 Mw, 55.4 Tg | 357.93 |
| LICOWAX ® EH11-19 10% solids | 230.63 |
| PAC Lot #4020914030 | 4.50 |
| 0.2 M $HNO_3$ | 40.50 |
| Shell Latex 1 | 177.22 |

Both formulations contained the high Mw resin of Example 1. Table 1 used a wax formulation wherein the wax was Polyethylene, P725 manufactured by Baker Petrolite. Table 2 had the novel wax formulation using a Montan wax octadecyl alcohol monoester, LICOWAX® EH11-19, obtained from Clariant Corporation that improved the overall toner flow. Pigment PB 15:3 Lot#W92914 (obtained from Sun Chemical) and PAC, Polyaluminum Chloride (Asada Chemical Industry Co., Ltd) were used. Melt Flow Index was determined as described above, that is, by measuring the weight of a toner (in grams) which passes through an orifice of length L and diameter D in a 10 minute period with a specified applied load of 16.6 kg. The "Tinius Olsen" melt indexer instrument was set to the following parameters; this was done by setting the instrument's desired sample temperature set point to 130° C., with the proper applied load force of 16.6 kg. The sample was then dispensed into the heated barrel of the melt indexer, equilibrated for six (6) minutes; then the specified load force was applied to the melt indexer's piston. The applied load caused the downward motion of the piston forcing the molten sample out a pre-determined orifice opening. The time was determined when a predetermined one (1) inch of travel by the piston was measured. The melt flow was calculated by the use of the time, distance, and weight volume extracted during the testing procedure.

Table 3 depicts the melt flow index improvement of the melt flow index from the control.

TABLE 3

| Sample | % Moisture | MFI @ 130° C. and 16.6 kg, g/10 minutes |
|---|---|---|
| Formulation 1 | 0.20 | 8.1 |
| Formulation 2 | 0.21 | 19.7 |

The two above toner runs were graphically compared in the FIGURE, showing the correlation between particle size of the control toner (as depicted in Table 1 above) and a toner of the present disclosure having a high molecular weight latex and a Montan wax octadecyl alcohol monoester. As can be seen in the FIGURE, the addition of the Montan wax octadecyl alcohol monoester shortened the aggregation time by about 118 minutes.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising a latex having a weight average molecular weight of from about 70 kpse to about 250 kpse and a Montan wax octadecyl alcohol monester having a melting point of from about 75° C. to about 85° C., wherein the toner has a melt flow index of from about 5 gm/10 min to about 40 gm/10 min at a temperature of about 130° C. and an applied load of about 16.6 kilograms.

2. The toner composition according to claim 1, wherein the latex has a weight average molecular weight of from about 75 kpse to 150 kpse and the wax has a melting point of from about 75° C. to about 81° C.

3. The toner composition according to claim 1, wherein the latex has a glass transition temperature of from about 54° C. to about 65° C.

4. The toner composition according to claim 3, wherein the latex has a glass transition temperature of from about 55° C. to about 61° C.

5. The toner composition according to claim 1, wherein the latex is selected from the group consisting of styrene acrylates, styrene butadienes, styrene methacrylates, and combinations thereof.

6. The toner composition according to claim 1, wherein the toner further comprises a colorant, and optionally one or more components selected from the group consisting of surfactants, coagulants, surface additives, and optionally mixtures thereof.

7. The toner composition according to claim 1, wherein the toner comprises an emulsion aggregation toner.

8. A xerographic system comprising a charging component, an imaging component, a development component, a transfer component and a fixing component, wherein the development component comprises a toner composition having a latex with a weight average molecular weight of from about 70 kpse to about 250 kpse and a Montan wax octadecyl alcohol monester with a melting point of from about 75° C. to about 85° C., and wherein the toner has a melt flow index of from about 5 gm/10 min to about 40 gm/10 min at a temperature of about 130° C. and an applied load of about 16.6 kilograms.

* * * * *